US005364110A

United States Patent [19]

Streich et al.

[11] Patent Number: 5,364,110

[45] Date of Patent: Nov. 15, 1994

[54] DOWNHOLE TOOL METAL-TO-METAL SEAL

[75] Inventors: Steven G. Streich; John T. Brandell; David D. Szarka; Bobby L. Sullaway, all of Duncan, Okla.

[73] Assignee: Halliburton Company, Duncan, Okla.

[21] Appl. No.: 990,336

[22] Filed: Dec. 11, 1992

[51] Int. Cl.[5] ..... F16J 15/08

[52] U.S. Cl. ..... 277/115; 277/117; 277/236; 166/196; 285/342

[58] Field of Search ..... 277/115, 116.2, 116.4, 277/116.6, 116.8, 117–120, 206 R, 236; 285/342, 343, 917; 166/82, 88, 196

[56] References Cited

U.S. PATENT DOCUMENTS

| | | | |
|---|---|---|---|
| 2,470,925 | 5/1949 | Fredrickson . | |
| 3,047,300 | 7/1962 | Taylor . | |
| 3,288,222 | 11/1966 | Urbanosky . | |
| 3,387,656 | 6/1968 | Guest . | |
| 3,387,661 | 6/1968 | Evans . | |
| 3,489,098 | 1/1970 | Roth . | |
| 3,599,490 | 8/1971 | Love . | |
| 3,915,462 | 10/1975 | Bruns . | |
| 4,131,287 | 12/1978 | Gunderson . | |
| 4,178,020 | 12/1979 | Dopyera . | |
| 4,315,543 | 2/1982 | Luers . | |
| 4,452,462 | 6/1984 | Karr . | |
| 4,471,965 | 9/1984 | Jennings . | |
| 4,474,382 | 10/1984 | Hjelsand . | |
| 4,477,085 | 10/1984 | Bridges . | |
| 4,477,091 | 10/1984 | Adamek . | |
| 4,478,423 | 10/1984 | Hjelsand . | |
| 4,510,960 | 4/1985 | Jennings . | |
| 4,613,159 | 9/1986 | Harris . | |
| 4,665,979 | 5/1987 | Boehm, Jr. | 277/117 X |
| 4,719,971 | 1/1988 | Owens | 166/196 X |
| 4,766,956 | 8/1988 | Smith . | |
| 4,787,642 | 11/1988 | Etheridge . | |
| 4,791,987 | 12/1988 | Cassity et al. | 277/116.6 X |
| 4,796,858 | 1/1989 | Kabel . | |
| 4,815,770 | 3/1989 | Hyne . | |
| 4,817,668 | 4/1989 | Smith, III | 277/206 R X |
| 4,823,871 | 4/1989 | McEver . | |
| 4,900,041 | 2/1990 | Hopkins et al. | 277/116.2 X |
| 5,038,862 | 8/1991 | Giroux . | |
| 5,044,672 | 9/1991 | Skeels . | |
| 5,246,236 | 9/1993 | Szarka et al. | 277/236 X |
| 5,259,457 | 11/1993 | Williamson, Jr. | 277/206 R X |

OTHER PUBLICATIONS

Metallic Sealing Technology In Downhole Completion Equipment, by William A. Blizzard—Paper; Oct. 1990.

*Primary Examiner*—Scott W. Cummings
*Attorney, Agent, or Firm*—James R. Duzan; Neal R. Kennedy

[57] ABSTRACT

A metal-to-metal annular seal for use in downhole tools which may include annular elastomeric backup seals. In each embodiment, a sealing member has a pair of annular frusto-conical lips adapted for sealing engagement with a cylindrical sealing surface on a member of a downhole tool. The sealing member may be a separate component or an integral part of another member of the downhole tool. A seal energizing member may be used.

6 Claims, 4 Drawing Sheets

DOWNHOLE TOOL METAL-TO-METAL SEAL

BACKGROUND OF THE INVENTION

This invention relates to improved types of seals for use in equipment in oil and gas wells and the like, and more particularly, to improved types of seals for sliding sleeve-type closures designed to maintain a sealing connection for relatively long time periods, such as the life of the well.

Sealing of components in oil and gas wells is of critical importance, both during the operation of downhole tools and for use in portions of the tools which remain in the well after completion, testing and production. For example, well apparatus with sliding closures frequently must be sealed during operation, and this sealing engagement must be maintained substantially indefinitely.

Prior art seals such as elastomeric seals can have problems over time in that the elastomer may lose resiliency or shape memory which is necessary for the seal to oppose the imposed forces thereon. This is a particular problem with exposure to downhole chemical and higher temperature environments of oil and gas wells for long periods of time. A seal is therefore required that remains operative in these types of environments.

Metal-to-metal seals have been developed because they are not affected by the chemicals and temperatures that are usually encountered. However, metal-to-metal seals are normally only used as static seals or as safety backup seals to standard elastomeric rotational or sliding seals because they have not been proven to be particularly suitable for use in dynamic sealing applications. One factor in the use of metal-to-metal seals is that the contacted sealing surfaces must be machined particularly smoothly and be free of pits and scratches so that a positive seal may be maintained. Damage to these surfaces can be caused by galling and scratching as the metal seal moves across the seal surface, and in such cases leakage is likely.

The present invention solves these problems by providing a new seal which incorporates the best aspects of metal-to-metal seals and elastomeric seals. In another embodiment, an improved metal-to-metal seal is also used to solve these problems.

Another type of prior art metal-to-metal seal is shown in U.S. Pat. No. 5,246,236. Such prior art metal-to-metal seal comprises a body portion disposable between the pair of members, a pair of annular arms extending from a side of the body portion, another pair of annular arms extending from an opposite side of the body portion, and a lip disposed on each of the arms adapted for engaging one of the members such that the first pair of arms are deflected toward one another and the second pair of arms are deflected toward one another. The two pairs of arms provide sealing in both directions. The arms are preferably integrally formed with the body portion.

In a preferred embodiment of such prior art metal-to-metal seal the apparatus further comprises elastomeric sealing means for dynamically sealing between the members as the members are relatively move. The body portion preferably defines a groove therein, and the dynamic sealing means is characterized by an elastomeric seal disposed in the groove.

One embodiment of such prior art metal-to-metal seal is characterized as a seal assembly for sealing between relatively movable first and second members, the first and second members defining a cavity therebetween. The seal assembly comprises a seal disposed in the cavity with a pusher ring disposed adjacent thereto. The seal comprises a body portion, a pair of annular arms extending from the body portion and defining a groove therebetween, and a lip on each of the arms. Each lip is adapted for sealing engagement with the sealing surfaces on one of the first and second members. The pusher ring has a portion extending therefrom into the groove such that longitudinal engagement by the lips with either of the first and second members is prevented.

The seal may further comprise a second pair of annular arms extending from an opposite side of the body portion from the first mentioned pair of arms, and a lip on each of the second pair of arms for sealing engagement wit-h the sealing surfaces of one of the first and second members. A second pusher ring is disposed on an opposite side of the seal and has a portion extending into the groove between the second pair of arms such that longitudinal engagement with the lips on the second pair of arms with the first and second members is prevented.

The seal assembly further comprises clamping means for clampingly engaging one of the pusher rings and thereby clamping the seal and the pusher rings to one of the first and second members.

Such prior art metal-to-metal seal further includes a sealed joint comprising a first member having a sealing surface defining first and second diameters, a second member having a sealing surface defining first and second diameters, the first and second diameters being relatively movable between first and second positions, and a seal defined between the first and second members. The seal comprises a body portion defining a groove therein, first and second annular arms extending from a side of the body portion and defining an annular groove therebetween, and third and fourth annular arms extending from an opposite side of the body portion from the first and second annular arms and defining an annular groove therebetween. First, second, third and fourth lips are disposed on the first, second, third and fourth arms, respectively. The first and third lips are spaced from the first diameter of the sealing surface of the first member when the first and second members are in the first position. The first and third lips are adapted for sealing engagement with the second diameter of the sealing surface of the first member when the first and second members are in the second position. The second and fourth lips are adapted for sealing engagement with the second diameter of the sealing surface of the second member. The seal in the seal joint further comprises an elastomeric sealing element disposed in the groove and adapted for sealing engagement with the first diameter of the sealing surface of the first member when the first and second members are in the first position and for tighter sealing engagement with the second diameter of the sealing surface of the first member when the first and second members are in the second position.

Yet other types of prior art seals having metal-to-metal sealing capabilities are illustrated in U.S. Pat. Nos. 2,470,925, 3,047,300, 3,288,222, 4,131,287, 3,915,462, 4,178,020, 4,452,462, 4,474,382, 4,766,956, 4,471,965, 4,477,085, 4,478,423, 4,787,642, 4,815,770, 4,823,871, and 5,044,672. Still yet other types of prior art seals having elastomeric seals, elastomeric and metal-to-metal seals or metal-to-metal seals are illustrated in U.S. Pat. Nos. 3,387,656, 3,387,661, 3,489,098, 3,599,490, 4,315,543, 4,477,091, 4,510,960, 4,613,159 and 4,796,858.

Also, metal-to-metal seals in downhole completion equipment are discussed in an October 1990 issued of the Journal of Petroleum Technology in an article entitled "Metallic Sealing Technology in Downhole Completion Equipment" by William A. Blizzard.

SUMMARY OF THE INVENTION

The present invention related to improved types of seals for sliding sleeve-type closures designed to maintain a sealing connection for use in equipment in oil and gas wells and the like. The improved types of seals of the present invention utilize metal-to-metal annular sealing surfaces and may include annular elastomeric back-up seals.

The various embodiments of the present invention will be better understood when the drawings are taken in conjunction with the detailed description of the invention.

DETAILED DESCRIPTION OF THE INVENTION

Figure 1:
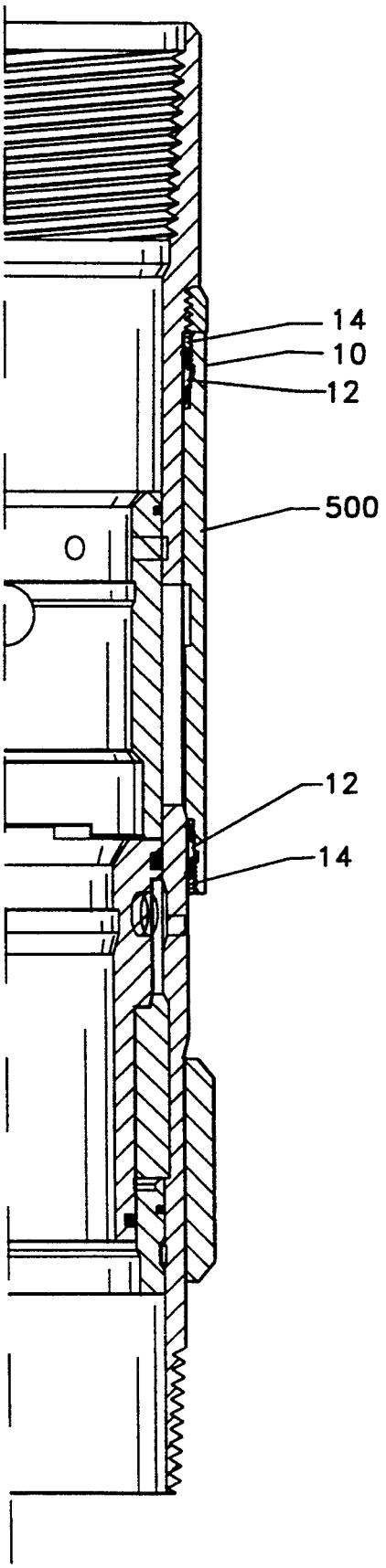
FIG. 1 is a quarter cross-sectional view of a tool incorporating a first embodiment of the present invention.

Referring to drawing FIG. 1, a first embodiment of the present invention of an improved seal 10 is shown in a well cementing tool 500.

The well cementing tool 500 is described and its operation set forth in U.S. Pat. No. 5,038,862 which is hereby incorporated by reference in this specification.

The improved seal 10 of the present invention comprises annular seal 12 and seal energizing member 14.

Figure 2:
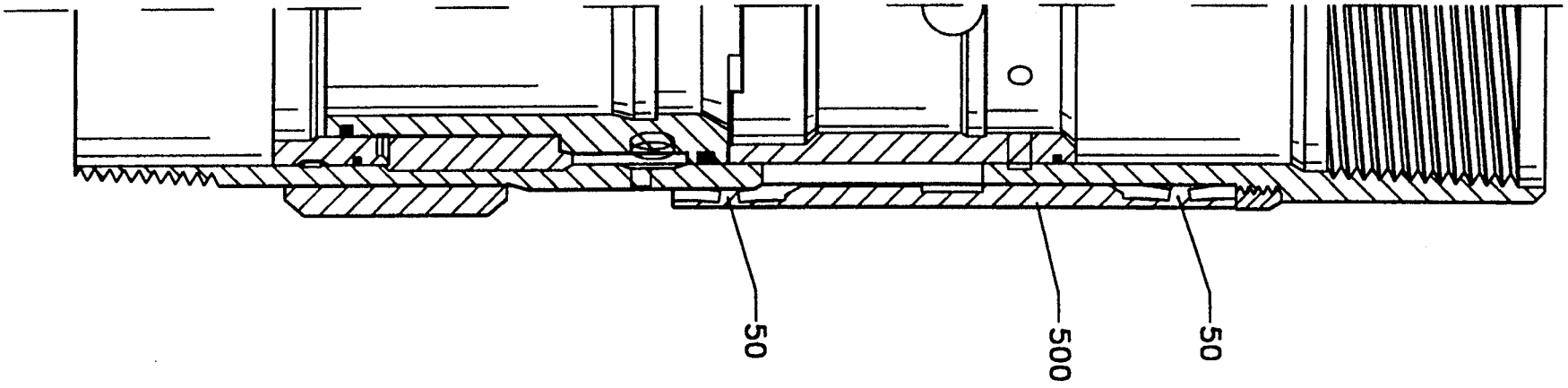
FIG. 2 is a quarter cross-sectional view of a tool incorporating a second embodiment of the present invention.

Referring to drawing FIG. 2, a second embodiment of the present invention of an improved seal 50 is shown integrally incorporated in a well cementing tool 500.

Figure 3:
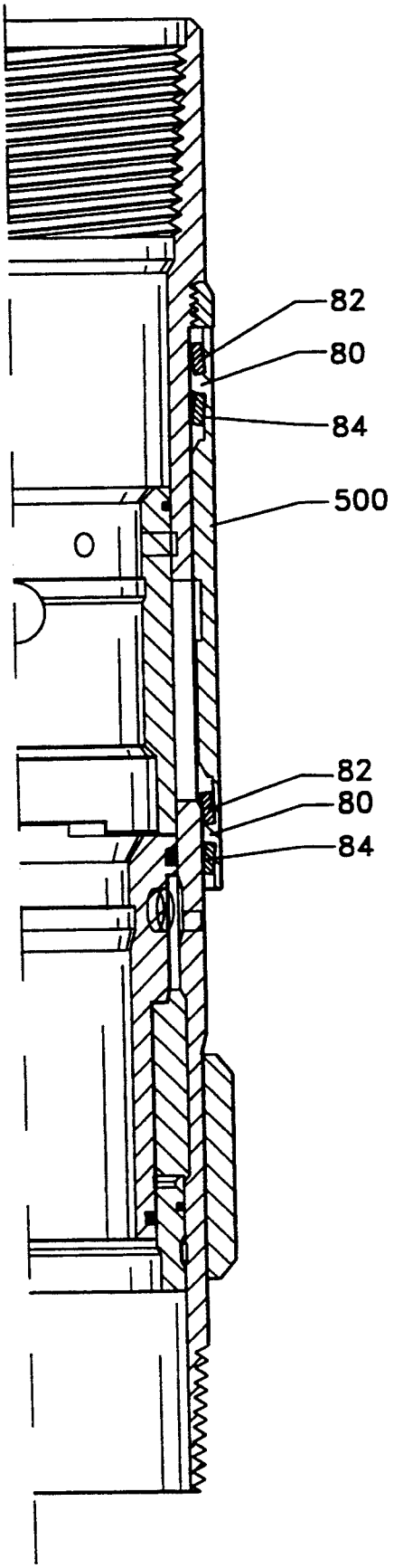
FIG. 3 is a quarter cross-sectional view of a tool incorporating a third embodiment of the present invention.

Referring to drawing FIG. 3, a third embodiment of the present invention of an improved seal 80 is shown incorporated in a well cementing tool 500. The improved seal 80 comprises integral annular seal 82 and annular elastomeric seal back-up members 84.

Figure 4:
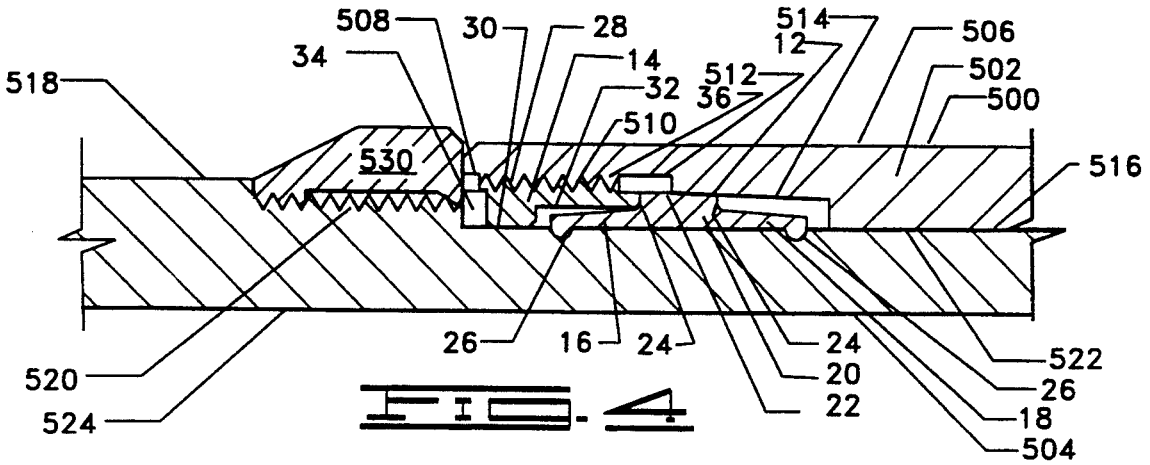
FIG. 4 is a partial cross-sectional view of the first embodiment of the present invention.

Referring to drawing FIG. 4, the first embodiment of the improved seal 10 is shown in more detail. The annular seal 12 and seal energizing member 14 are shown with respect to an outer cylindrical member 502 and inner cylindrical member 504 of the cementing tool 500.

The outer cylindrical member 502 is formed having an outer surface 506 and having, on the interior of one end thereof, first bore 508, threaded bore 510, second bore 512, frusto-conical annular bore 514 and third bore 516.

The inner cylindrical member 504 is formed having first outer surface 518, threaded outer surface 520, and second outer surface 522 and, on the interior thereof, bore 524.

The annular seal 12 comprises an annular cylindrical member having a first frusto-conical annular lip 16 and a second frusto-conical annular lip 18 extending from body portion 20 having, in turn, a frusto-conical outer surface 22 which slidingly engages frusto-conical annular bore 514 of tool 500 and annular shoulders 24 formed thereon. The first lip 16 and second lip 18 may be formed having annular ribs 26 on the interior thereof, The seal energizing member 14 comprises an annular cylindrical member having, on the exterior thereof, threaded surface 28 which threadedly engages threaded bore 510 of tool 500 and, on the interior thereof, first bore 30 and second bore 32. On one end of the seal energizing member 14 are a plurality of recesses 34 while on the other end of member 14 is annular lip 36 which abuts an annular shoulder 24 of annular seal 12.

The tool 500, as shown, also includes threadedly adjustable top shoe 530.

Figure 5:
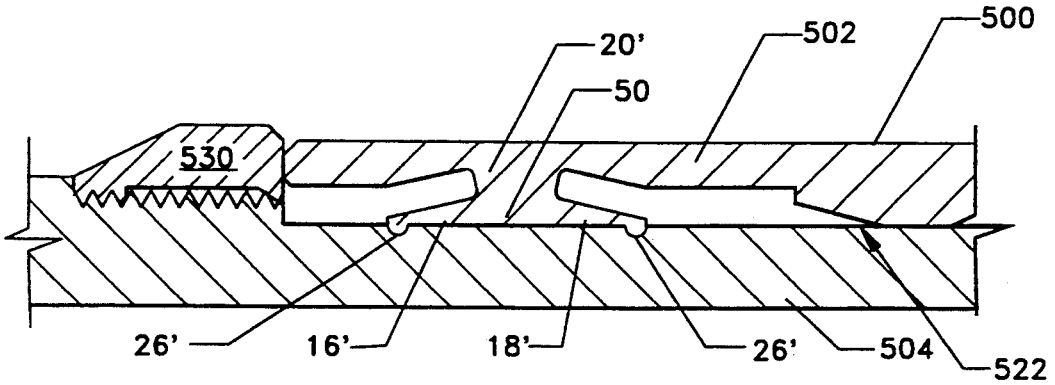
FIG. 5 is a partial cross-sectional view of the second embodiment of the present invention.

Referring to FIG. 5, the improved seal 50 of the present invention is shown integrally incorporated in a well cementing tool 500. As shown, the seal 50 is formed as part of a first, the outer cylindrical, member 502, of the tool 500. Alternately, the seal 50 could be formed on the inner cylindrical member 504 of the tool 500.

The seal 50 is similar in construction to the seal 20 having first frusto-conical annular lip 16' and second frusto-conical annular lip 18' extending from body portion 20'. The first lip 16' and second lip 18' may be formed having annular ribs 26' on the interior thereof.

As shown, the tool 500 includes threadedly adjustable top shoe 530.

Figure 6:
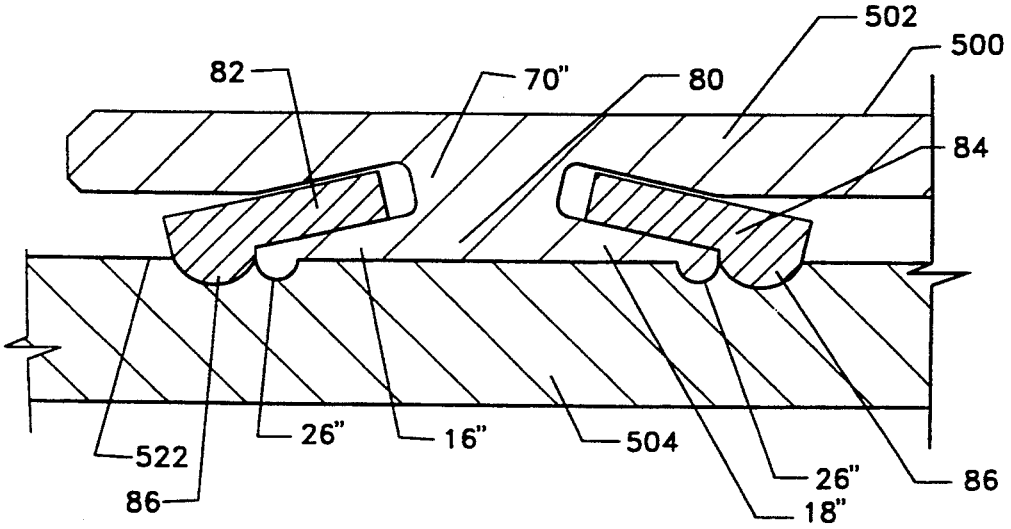
FIG. 6 is a partial cross-sectional view of the third embodiment of the present invention.

Referring to drawing FIG. 6, the improved seal 80 of the present invention is shown integrally incorporated along with annular elastomeric seal back-up members 84. The seal 80 is similar in construction to the seal 50 having first frusto-conical annular lip 16" and second frusto-conical annular lip 18" extending from body portion 20". The first lip 16" and second lip 18" may be formed having annular ribs 26" on the interior thereof.

The annular elastomeric back-up members 84 each comprise an annular frusto-conical elastomeric member with each having an annular rib 86 thereon. The annular elastomeric back-up member 84 may be formed of any suitable elastomeric material for use in well tools, such as nitrile type rubbers, teflon, etc. Each annular elastomeric back-up member 84 is retained on first lip 16" or second lip 18" of the seal 80 either by bonding or by adhesive attachment.

The annular elastomeric back-up member 84 serves as a back-up seal for the seal 80 as well as a wiper to wipe debris and fluids from the surface upon which first lip 16" and second lip 18" slidingly seal in a tool 500.

Referring to drawing FIGS. 4, 5 and 6 the annular ribs 26, 26' and 26" on each seal 20, 50 and 80 respectively are illustrated to show an interference type sealing relationship with the surface 522 of the tool 500. When the tool 500 is assembled, the annular ribs 26, 26' and 26" on each seal 20, 50 and 80 respectively slidingly, sealing engaging the surface 522 of the adjacent portion of the tool 500 in an interference relationship to cause effective sealing of the tool 500. Regarding drawing FIG. 6, the annular ribs 86 on the elastomeric backup members 84 also engage surface 522 in the same manner.

From the foregoing it can be seen that the present invention provides a metal-to-metal seal for a downhole tool where the metal-to-metal seal can be provided as a separate sealing member or an integral sealing member and, may include, an elastomeric back-up seal member.

Having thus described our invention, we claim:

1. A sealing arrangement for a downhole tool, said sealing arrangement comprising:

a first member of said downhole tool having an annular cavity formed in one end thereof, the annular cavity having a threaded portion and having a frusto-conical annular surface;

a second member of said downhole tool having a cylindrical sealing surface thereon;

an annular sealing member having a first frusto-conical annular lip and having a second frusto-conical annular lip extending from a body portion having, in turn, a frusto-conical outer surface which is adapted to engage the frusto-conical annular surface of the annular cavity of the first member of said downhole tool, the first frusto-conical annular lip and the second frusto-conical annular lip each having an annular rib thereon; and a seal energizing member having, on the exterior thereof, a threaded surface which threadedly engages the threaded portion of the annular cavity of the first member of the downhole tool and an annular lip which abuts a shoulder of the annular sealing member when the annular sealing member and seal energizing member area assembled in said downhole tool such that said frusto-conical outer surface of said annular sealing member engages said frusto-conical annular surface of the annular cavity of said first member.

2. The sealing arrangement of claim 1 further including an adjustable top shoe.

3. A sealing arrangement for a downhole tool, said sealing arrangement comprising:

a first member of said downhole tool having integrally formed thereon a metal seal having a first frusto-conical annular lip and a second frusto-conical annular lip extending form a body portion, the first frusto-conical annular lip and second frusto-conical annular lip each having an annular rib thereon; and a second member of said downhole tool having a cylindrical sealing surface thereon having an interference type sealing relationship with the annular rib on the first frusto-conical annular lip and the annular rib on the second frusto-conical annular lip.

4. The sealing arrangement of claim 3 further including an adjustable top shoe on said downhole tool.

5. A sealing arrangement for a downhole tool, said sealing arrangement comprising:

a first member of said downhole tool having integrally formed thereon a metal seal having a first frusto-conical annular lip and a second frusto-conical annular lip extending from a body portion, the first frusto-conical annular lip and second frusto-conical annular lip each having an annular rib thereon;

a first annular frusto-conical elastomeric member overlaying the first frusto-conical annular lip of the first member, the first annular frusto-conical elastomeric member having an annular rib thereon;

a second annular frusto-conical elastomeric member overlaying the second frusto-conical annular lip of the first member, the second annular frusto-conical elastomeric member having an annular rib thereon; and a second member of said downhole tool having a cylindrical sealing surface thereon having an interference type sealing relationship with the annular rib of the first frusto-conical annular lip and the annular rib of the second frusto-conical annular lip, said cylindrical sealing surface being adapted to sealingly engage the annular rib of the first annular frusto-conical elastomeric member and the annular rib of the second annular frusto-conical elastomeric member.

6. The sealing arrangement of claim 5 wherein the first member is an outer member of said downhole tool.

* * * * *